United States Patent [19]

Olson

[11] Patent Number: 4,917,129

[45] Date of Patent: Apr. 17, 1990

[54] TEASE COMB/HAIR PICK

[75] Inventor: Bradley T. Olson, Cohasset, Minn.

[73] Assignee: Mebco Industries, Inc., Eagan, Minn.

[21] Appl. No.: 190,763

[22] Filed: May 6, 1988

[51] Int. Cl.[4] ..... A45D 24/00

[52] U.S. Cl. ..... 132/161; 132/150

[58] Field of Search ..... 132/219, 126, 137, 138, 132/139, 141, 142, 152, 159, 161, 150; D28/31, 21

[56] References Cited

U.S. PATENT DOCUMENTS

| | | | |
|---|---|---|---|
| D. 199,657 | 11/1964 | Vallis | D28/21 |
| D. 211,705 | 7/1968 | Sampedro | D28/31 |
| D. 224,847 | 9/1972 | Thomas | D28/21 |
| 1,281,227 | 10/1918 | Sumitani | 132/161 |
| 1,671,094 | 5/1928 | Widdows | 132/126 |
| 3,424,174 | 1/1969 | Battaglia | 132/11 R |
| 3,459,199 | 8/1969 | Connell | 132/11 R |
| 3,473,540 | 10/1969 | Bulow | 132/139 |
| 4,345,608 | 8/1982 | Cavaioli | 132/160 |
| 4,359,061 | 11/1982 | Colclasure | 132/144 |

*Primary Examiner*—Robert Peshock
*Assistant Examiner*—Adriene J. Lepiane
*Attorney, Agent, or Firm*—John W. Bunch

[57] ABSTRACT

An improved tease comb or hair pick (10) includes a handle (12) and a row of teeth (14, 16 and 18) thereon. A medium length tooth (16) is provided between each pair of long teeth (14) and a short tooth (18) is provided between each medium tooth and the adjacent long tooth, in order quickly to provide more volume with less tangling and knotting.

4 Claims, 1 Drawing Sheet

TEASE COMB/HAIR PICK

TECHNICAL FIELD

The present invention relates generally to hair combs or picks. More particularly, this invention concerns an improved tease comb for backcombing hair to create more volume more quickly with less tangling.

BACKGROUND

Various combs and hair picks have been available heretofore to facilitate grooming one's hair as desired. Some of these have been adapted to create some special effect, other than smoothing the hair. The tease comb is one such example. Tease combs are used to backcomb hair, thus ratting or teasing it to create the effect of more volume. In order to accomplish this, combs or hair picks with different tooth arrangements have been devised.

One popular form of tease comb includes teeth of three different lengths, with one short or medium length tooth between alternating adjacent pairs of long teeth. U.S. Pat. No. 3,473,540 to Bulow shows a comb having this tooth arrangement. However, tease combs of this type tend to leave the hair too tangled and tightly packed, and are relatively time consuming to use.

U.S. Pat. No. 4,345,608 to Cavaioli shows another comb for raising or teasing hair. This comb incorporates teeth of uniform length, alternate ones of which include opposite raised portions for channeling and separating the hair. This comb, however, is better suited for lifting, rather than teasing hair.

A need has thus arisen for an improved tease comb or pick which provides more volume with less tangling and knotting in less time.

SUMMARY OF THE INVENTION

The present invention comprises an improved tease comb or pick which overcomes the foregoing and other difficulties associated with the prior art. In accordance with the invention, there is provided a tease comb or pick having a unique tooth arrangement in order to gain more volume with less tangling in less time. The comb or pick herein includes teeth of three lengths. Between each pair of long teeth there is one medium length tooth and two short teeth. One short tooth is provided between each medium tooth and the adjacent long tooth. The teeth are preferably uniformly spaced apart. The long teeth are preferably circular at their tips, while the tips of the short and medium teeth are preferably oval.

BRIEF DESCRIPTION OF DRAWING

A better understanding of the invention can be had by reference to the following Detailed Description in conjunction with the accompanying Drawing, wherein.

DETAILED DESCRIPTION

Figure 1:
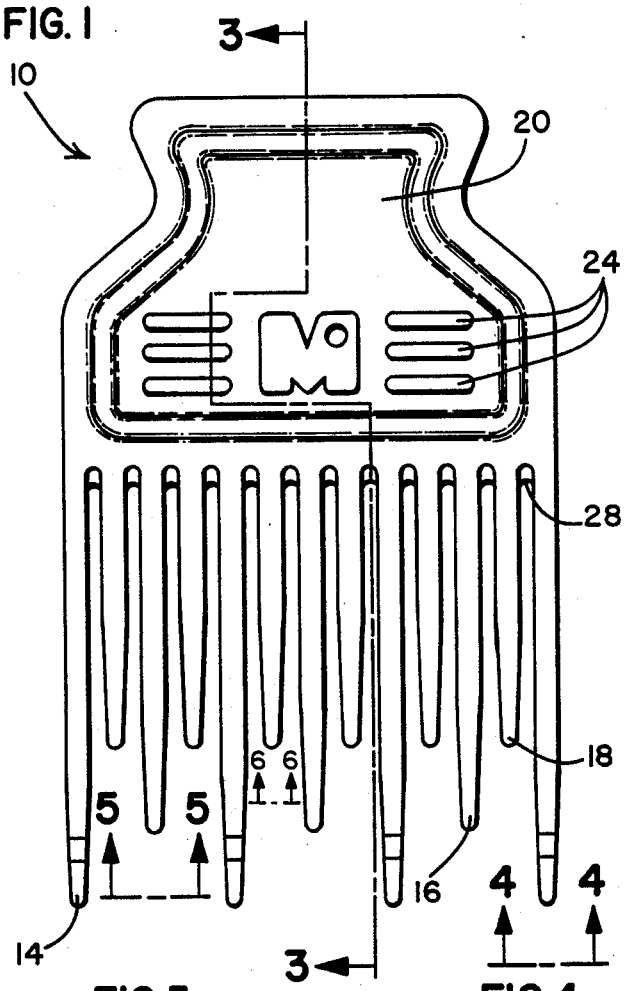
FIG. 1 is a plan view of one side of the tease comb incorporating the invention.

Referring now to the Drawing, wherein like reference numerals designate like or corresponding elements throughout the views, there is shown a tease comb or pick 10 incorporating the invention. As will be explained more fully hereinafter, the comb 10 is particularly adapted to provide the hair styling effect of more volume with less tangling and knotting in less time.

The comb 10 includes a handle 12 with a row of teeth 14, 16 and 18 extending from one side thereof. Although one form of handle 12 has been shown, it will be understood that other forms or shapes could be used. The particular shape of handle 12 is not critical to practice of the invention.

The handle 12 and teeth 14, 16 and 18 are preferably molded as an integral unit. The comb 10 can be constructed from a suitable plastic, such as polypropylene, for example.

Figure 3:
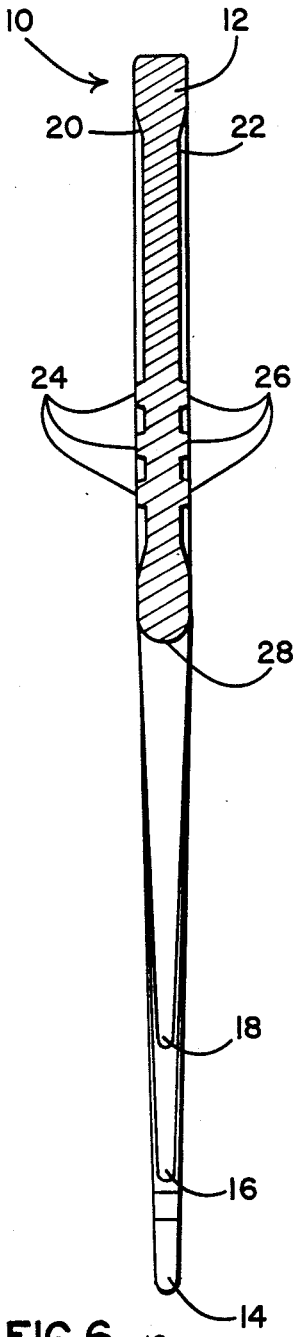
FIG. 3 is an enlarged sectional view taken along lines 3—3 of FIG. 1 in the direction of the arrows.
Figure 2:
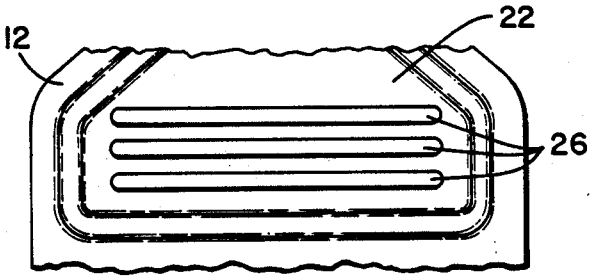
FIG. 2 is a partial plan view of the other side of the handle of the tease comb herein.
Figure 6:
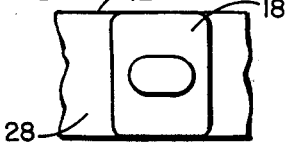
FIG. 6 is an enlarged end view of one of the short teeth.

Referring particularly to FIGS. 1, 2 and 3, the handle 12 preferably includes recesses 20 and 22 on opposite sides thereof. Transverse raised ribs 24 are provided in recess 20, while ribs 26 are provided in the opposite recess 22 to facilitate handling by the user. These features are important, but the significance of the present invention lies in the tooth configuration.

The teeth 14, 16 and 18 are arranged in a row along one side 28 of the handle 12. As shown, the comb 10 includes four long teeth 14, three medium or intermediate teeth 16, and six short teeth 18, although any suitable number of teeth can be used in the inventive arrangement. In accordance with the preferred construction, one intermediate tooth 16 and two short teeth 18 on either side of the intermediate tooth, are provided between each pair of long teeth 14. A short tooth 18 is thus provided between each medium length tooth 16 and the adjacent long tooth 14 as shown. This particular tooth arrangement comprises a significant feature of the present invention.

Figure 5:
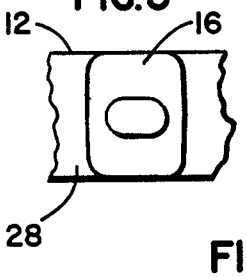
FIG. 5 is an enlarged end view of one of the intermediate or medium teeth.
Figure 4:
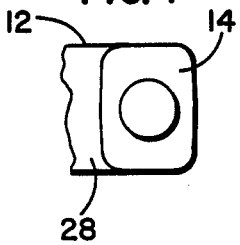
FIG. 4 is an enlarged end view of one of the long teeth.

In accordance with the preferred embodiment, the teeth 14, 16 and 18 are spaced substantially uniformly apart. Each tooth is of generally square or rectangular cross-section near handle 12, but is tapered at its terminal end. The long teeth 14 are preferably of substantially circular cross section at their terminal ends, as shown in FIG. 4. For example, the end portions of teeth 14 can be about 0.10 inch in diameter. The medium length teeth 16 are preferably of substantially oval cross section at their terminal ends, as shown in FIG. 5. For example, the end portions of teeth 16 can be about 0.10 $\times$ 0.06 inch in size. The terminal ends of short teeth 18 are also of substantially oval configuration, similar to the medium teeth 16. Further, the portions of side 28 of handle 12 between the teeth are preferably rounded as shown in FIG. 3 to minimize catching.

As illustrated, for example, the teeth 14, 16, and 18 can be about 0.08 inch apart. Teeth 14 can be about 2.50 inches long. Teeth 16 can be about 2.06 inches long. Teeth 18 can be about 1.63 inches long. The ratio of the relative lengths of teeth 14, 16 and 18 is about 1.5/1.3/1.

If desired, the terminal tips of teeth 14, 16 and 18 can be coated by means of a dipping process to provide enlarged, smooth tips covering any mold parting lines or flashing, for greater comfort as disclosed in co-pending application Ser. No. 059,224, filed May 21, 1987.

From the foregoing, it will thus be apparent that the present invention comprises an improved tease comb or pick having numerous advantages over the prior art. By means of the comb herein, hair can be quickly teased in order to create the effect of more volume with less knotting and tangling. Other advantages will be evident to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and/or rearrangements of elements falling within the scope of the invention as defined by the following Claims.

What is claimed is:

1. A tease comb, which comprises:

a handle;

groups of teeth secured in a straight row to said handle in uniformly spaced-apart relationship;

each tooth including a proximal portion connected to said handle and a distal portion adjacent to a free terminal end;

the distal portions of at least some of said teeth being tapered toward their free terminal ends;

each group of teeth including a pair of relatively long teeth with a single medium length tooth positioned midway therebetween and a single short tooth positioned midway between the medium tooth and each long tooth of the pair in order to form a long/-short/medium/short/long teeth arrangement;

the distal portions of at least some of said long teeth being substantially circular in cross section;

the distal portions of at least some of said medium length teeth being substantially oval in cross section;

the distal portions of at least some of said short teeth being substantially oval in cross section; and said handle and teeth being integrally molded from plastic.

2. The tease comb of claim 1, wherein said handle includes rounded portions between at least some of said teeth.

3. The tease comb according to claim 2, wherein the ratio of the relative lengths of the long/medium/short teeth in each group is about 1.5/1.3/1.

4. The tease comb according to claim 3, wherein said handle and teeth are integrally molded from polypropylene.

* * * * *